US006279322B1

(12) United States Patent
Moussa

(10) Patent No.: US 6,279,322 B1
(45) Date of Patent: Aug. 28, 2001

(54) DESWIRLER SYSTEM FOR CENTRIFUGAL COMPRESSOR

(75) Inventor: Zaher M. Moussa, Salem, MA (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/390,876

(22) Filed: Sep. 7, 1999

(51) Int. Cl.[7] ..... F02C 1/00
(52) U.S. Cl. ..... 60/751
(58) Field of Search ..... 60/748, 751, 39.36; 415/208.3, 208.2, 208.1, 211.1, 211.2, 115

(56) References Cited

U.S. PATENT DOCUMENTS

| | | | | |
|---|---|---|---|---|
| 2,681,760 | | 6/1954 | Lundquist | 230/127 |
| 3,333,762 | | 8/1967 | Vrana | 415/207 |
| 3,861,826 | | 1/1975 | Dean, Jr. | 415/211 |
| 4,027,997 | * | 6/1977 | Bryans | 415/207 |
| 4,100,732 | * | 7/1978 | Bryans et al. | 60/39.36 |
| 4,979,361 | | 12/1990 | Clark et al. | 60/39.36 |
| 4,981,018 | * | 1/1991 | Jones et al. | 60/726 |
| 5,011,371 | | 4/1991 | Gottemoller | 415/211.1 |
| 5,062,262 | * | 11/1991 | Shekleton et al. | 60/39.36 |
| 5,101,620 | * | 4/1992 | Shekleton et al. | 60/39.36 |
| 5,129,224 | * | 7/1992 | Shekleton et al. | 60/39.36 |
| 5,303,543 | * | 4/1994 | Shah et al. | 60/39.36 |
| 5,335,501 | | 8/1994 | Taylor | 60/751 |
| 5,680,767 | | 10/1997 | Lee et al. | 60/760 |
| 5,709,531 | | 1/1998 | Nishida et al. | 415/208.2 |

FOREIGN PATENT DOCUMENTS

| | | |
|---|---|---|
| 0884507 | 12/1961 | (GB) . |
| 2176539 | 12/1986 | (GB) . |

OTHER PUBLICATIONS

Nippert, Ü ber den Ströungsverlust in gekrëmmten Kanälen, Forschungsarbeiten auf dem Gebiete des Ingenieurwesens, Herausgegeben vom Verein Deutscher Ingenieure (1929).

Weske, Pressure Loss in Ducts with Compounds Elbows, NACA Wartime Report (1943).

Itō, Pressure Leses in Smooth Pipe Bends, Journal of Basic Engineering (Mar. 1960), pp. 131–143.

Sagi et al., The Design and Performance of Two–Dimensional, Curved Diffusers, Part I—Exposition of Method, Journal of Basic Engineering (Dec. 1967), pp. 715–731.

* cited by examiner

*Primary Examiner*—Timothy S. Thorpe
*Assistant Examiner*—W. Rodriguez
(74) *Attorney, Agent, or Firm*—Andrew C. Hess; Nathan D. Herkamp

(57) ABSTRACT

A deswirler system for a centrifugal compressor of a gas turbine engine that improves overall engine performance as a result of exhibiting significantly reduced friction losses. The deswirler system generally entails an annular-shaped manifold having an inlet configured to receive radially-outward flowing gas from a diffuser of the compressor, an outlet configured to discharge the gas in an axial downstream direction, and an arcuate passage therebetween. The deswirler system further includes a plurality of deswirler vanes directly within the arcuate passage and closely coupled to the diffuser.

25 Claims, 5 Drawing Sheets

FIG.6
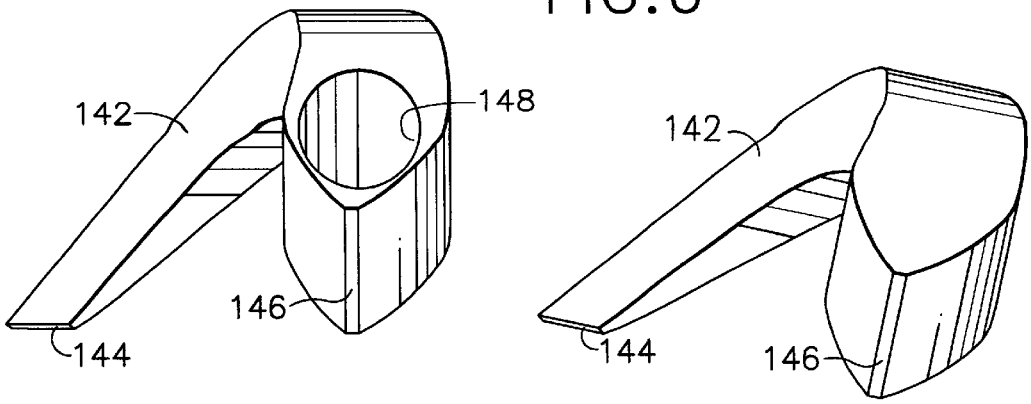
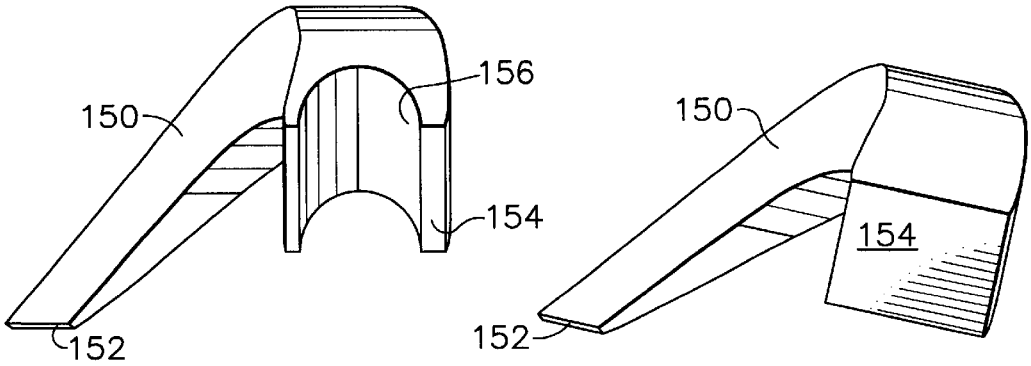
FIG.7
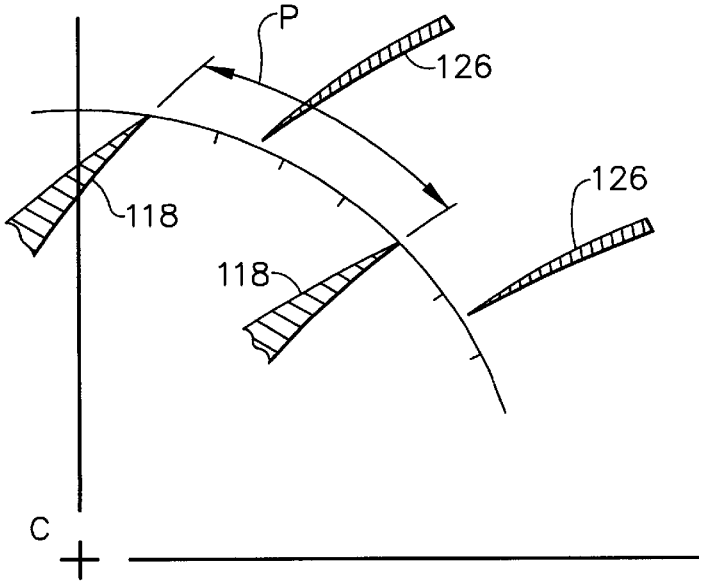
FIG.8

DESWIRLER SYSTEM FOR CENTRIFUGAL COMPRESSOR

FIELD OF THE INVENTION

The present invention relates to the components of a gas turbine engine that receive radial high-velocity airflow from a centrifugal compressor, and then deliver the air to an annular-shaped combustor of the engine. More particularly, this invention relates to a compact deswirler system closely coupled to a diffuser and composed of deswirler vanes located within a bend that redirects the airflow from a radially outward direction to a generally axial direction.

BACKGROUND OF THE INVENTION

Shown in FIG. 1 are portions of a centrifugal compressor 10 and annular-shaped combustor 12 of a gas turbine engine. The compressor 10 generally includes a rotating impeller 14 configured to accelerate and thereby increase the kinetic energy of the gas flowing therethrough. A stationary annular-shaped diffuser 16 circumscribes the impeller 14, and serves to decrease the velocity of fluid flow leaving the impeller 14 and thereby increase its static pressure. Diffusers are typically composed of either vanes or pipes that define a plurality of circumferentially-spaced passages 18. The cross-sectional area of each passage 18 typically increases downstream of the impeller 14 in order to diffuse the flow exiting the impeller 14.

Both vane and pipe-type diffusers generally include a transition region 20 downstream of the diffuser passages 18 to match the diffuser flowpath to the geometry of the combustor 12. As shown in FIG. 1, the transition region 20 includes an annular manifold 22 that receives the radially-outward air flow from the diffuser 16, and redirects this airflow aft and often radially inward (as shown) toward the annular-shaped entrance of the combustor 12. The manifold 22 terminates with a generally straight section 24 in which a number of deswirler vanes 26 are positioned immediately upstream of the entrance to the combustor 12. The vanes 26 serve to remove the residual circumferential swirl from the flow exiting the diffuser 16 by converting the high tangential velocity component of the flow exiting the diffuser passages 18 to a more useful static pressure. As a result, the flow exiting the deswirler vanes 26 and directed into the combustor 12 is characterized by relatively low swirl and Mach number and a particular meridional ("spouting") angle that together achieve more stable and efficient combustor performance. In a multistage centrifugal compressor, a diffuser and transition region may be used between each consecutive pair of stages to decelerate and deswirl the air flow exiting the leading stage to a level appropriate for the trailing stage.

The manifold 22 shown in FIG. 1 generally defines an axi-symmetric free bend that is bounded by one (outer) surface, though bends bounded by two (inner and outer) surfaces are also known. The deswirler vanes 26 within the straight section 24 that follows the bend within the manifold 22 are generally arranged on a conical axi-symmetric flow path. Though a single row of vanes 26 is shown, double-row configurations are known. As a rule, the vanes 26 have been placed downstream of the bend and immediately upstream or at the entrance of the combustor 12.

While diffuser and deswirler systems of the type shown in FIG. 1 perform well in a number of successful gas turbine engines, further improvements in the performance are continuously being sought. Of primary interest is achieving reductions in pressure losses that reduce engine performance.

BRIEF SUMMARY OF THE INVENTION

The present invention provides a deswirler system for a centrifugal compressor of a gas turbine engine that improves overall engine performance as a result of exhibiting significantly reduced diffusion (secondary flow) and friction losses. According to this invention, the deswirler system generally entails an annular-shaped manifold having an inlet configured to receive radially-outward flowing gas from a diffuser, an outlet configured to discharge the gas in an axial downstream direction, and an arcuate passage therebetween. In contrast to prior art practices, the deswirler system of this invention provides a plurality of deswirler vanes directly within the arcuate passage and closely coupled to the diffuser, instead of being limited to being within a straight section downstream of the arcuate passage.

A significant advantage of the deswirler system of this invention is the reduction in pressure losses that reduce engine performance. Though not wishing to be held to any particular theory, it is believed that placing the deswirler vanes within the bend that turns the air/gas flow from the radial flow direction of the diffuser to the generally axial flow direction required by the compressor, reduces the amplification of the secondary flow as the air/gas leaves the diffuser. Consequently, the deswirler system of this invention is believed to eliminate bend losses and reduces secondary flow losses attributable to a tangentially unguided bend.

Another significant advantage of this invention is that the total length over which the air/gas travels from the diffuser exit to the combustor plenum is reduced, resulting in less total surface area wetted by the air/gas and, therefore, reduced skin friction losses. The diffuser/deswirler system is also more compact than prior art systems, and enables the weight of the engine to be significantly reduced.

Yet another important aspect of this invention is the determination that placement of the deswirler vanes within the arcuate passage immediately adjacent the diffuser allows for aerodynamic advantages through close coupling the deswirler vanes to the diffuser. For example, improved efficiencies can be realized through appropriate relative circumferential positioning of the deswirler vanes relative to the diffuser passages. As a result, the invention provides greater design flexibility in terms of optimizing the diffuser-deswirler system match to further minimize losses attributable to the diffuser-deswirler interface.

Other objects and advantages of this invention will be better appreciated from the following detailed description.

BRIEF DESCRIPTION OF THE DRAWINGS

FIGS. 5 through 7 represent isolated perspective views of alternative embodiments for the deswirler vanes shown in FIGS. 2 through 4.

FIG. 8 represents an aft-looking-forward view of the diffuser and deswirler vanes shown in FIGS. 2 and 3.

DETAILED DESCRIPTION OF THE INVENTION

Figure 1:
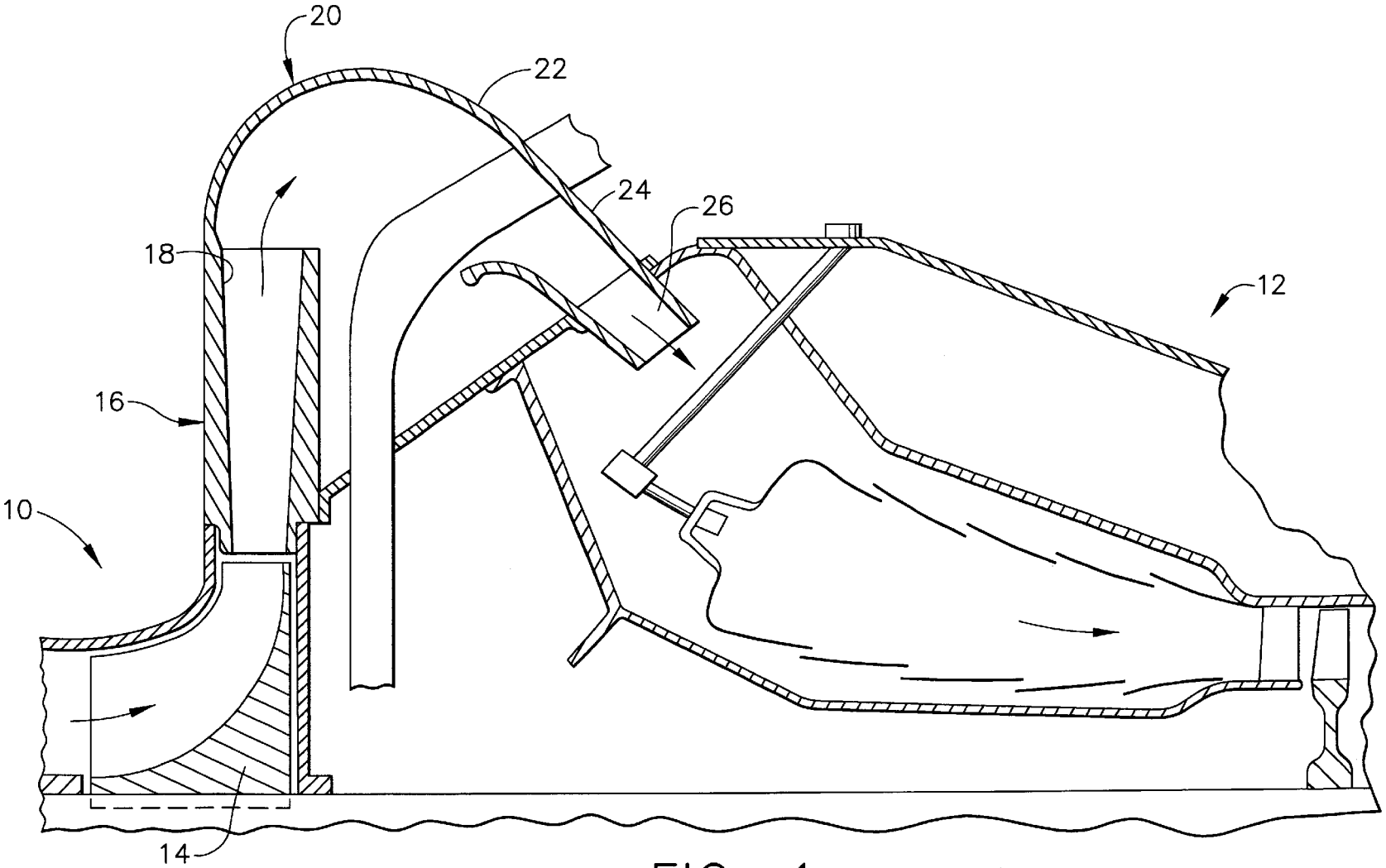
FIG. 1 (PRIOR ART)
FIG. 1 is a partial cross-sectional view of a diffuser and deswirler system for a centrifugal compressor of a gas turbine engine of the prior art.
Figure 2:
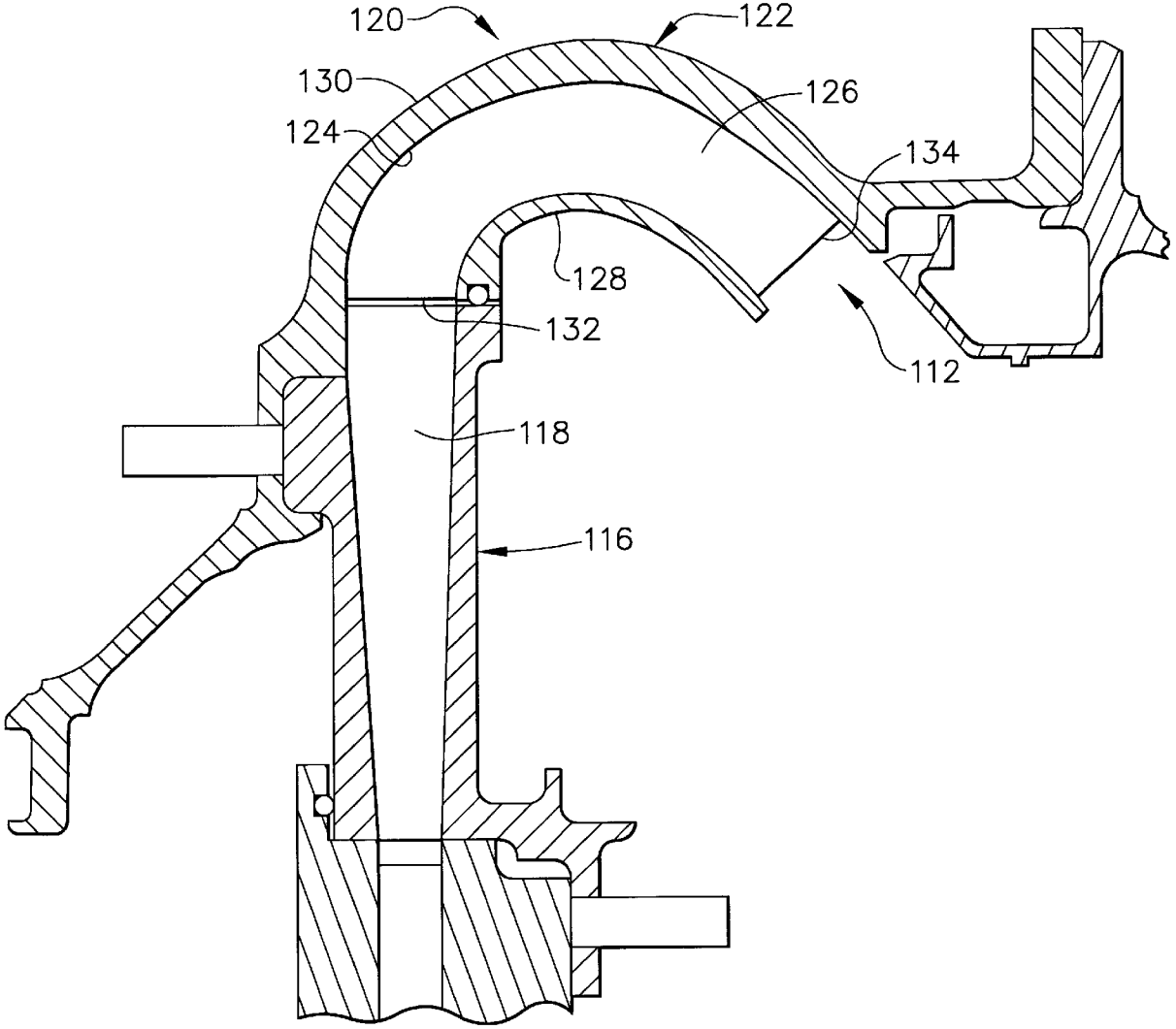
FIGS. 2 and 3 represent cross-sectional and perspective views, respectively, of a diffuser and deswirler system in accordance with this invention.
Figure 3:
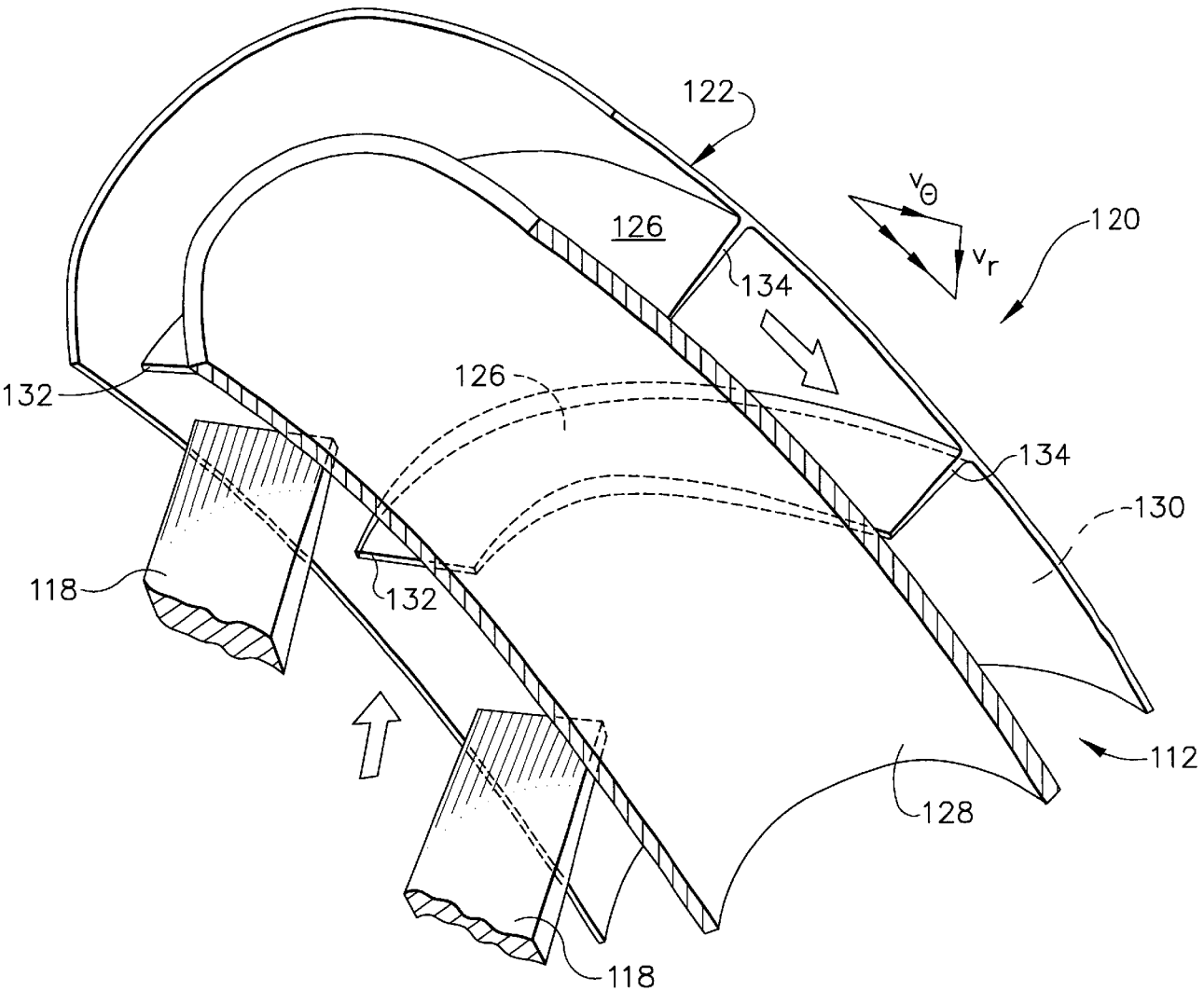

FIG. 2 represents in cross-section a closely-coupled diffuser and deswirler system in accordance with a preferred embodiment of this invention, while FIG. 3 is an isolated perspective view of the system shown in FIG. 2. Common to the system shown in FIG. 1, the deswirler system of this invention is employed with a stationary diffuser 116 equipped with vanes 118 that direct the swirling air or gas that flows generally radially from the impeller of a centrifugal compressor (not shown) to the annular-shaped inlet 112 of a gas turbine engine combustor (not shown). The deswirler system of this invention also includes a transition region 120 immediately downstream of the diffuser 116. As with the system shown in FIG. 1, the transition region 120 includes an annular manifold 122 that receives the radially-outward air flow from the diffuser 116, and redirects this airflow aft and radially inward toward the entrance 112 of the combustor. It is within the scope of this invention that the manifold 122 could turn the flow from the diffuser 116 by as little as about 90 degrees, and as much as about 180 degrees, though it is believed that a turn angle of about 130 to about 140 degrees would be more typical. While the diffuser 116 will be described in terms of having a vane-type configuration, the teachings of this invention are also applicable to pipe-type diffusers.

The manifold 122 shown in FIGS. 2 and 3 defines an axi-symmetric bend 124 bounded by a pair of radially inner and outer surfaces 128 and 130, respectively, that are typically defined by the compressor hub and casing. The manifold 122 causes the flow entering the combustor to be characterized by a relatively low Mach number and a particular meridional ("spouting") angle that together achieve more stable and efficient combustor performance.

Disposed within the axi-symmetric bend 124 of the manifold 122 are a number of deswirler vanes 126. As such, the deswirler vanes 126 of this invention are not limited to being located within a straight section downstream of the bend 124, such as within the conical axi-symmetric flow path shown for the prior art in FIG. 1. The vanes 126 serve the traditional role of removing the residual circumferential swirl from the flow exiting the diffuser 116 by converting the high tangential velocity component of the flow exiting the diffuser 116 to a more useful static pressure. However, the placement of the vanes 126 within the bend 124 also enables the vanes 126 to be closely coupled to the diffuser 116, in addition to being closely coupled to the combustor inlet 112. As used herein, the term "closely coupled" is used to denote that clearances are reduced to those necessary for component assembly and operation without interference. Accordingly, the vanes 126 shown in FIGS. 2 and 3 are closely coupled to the diffuser 116, while the deswirler vanes 26 of FIG. 1 are not closely coupled to the diffuser 16.

Figure 4:
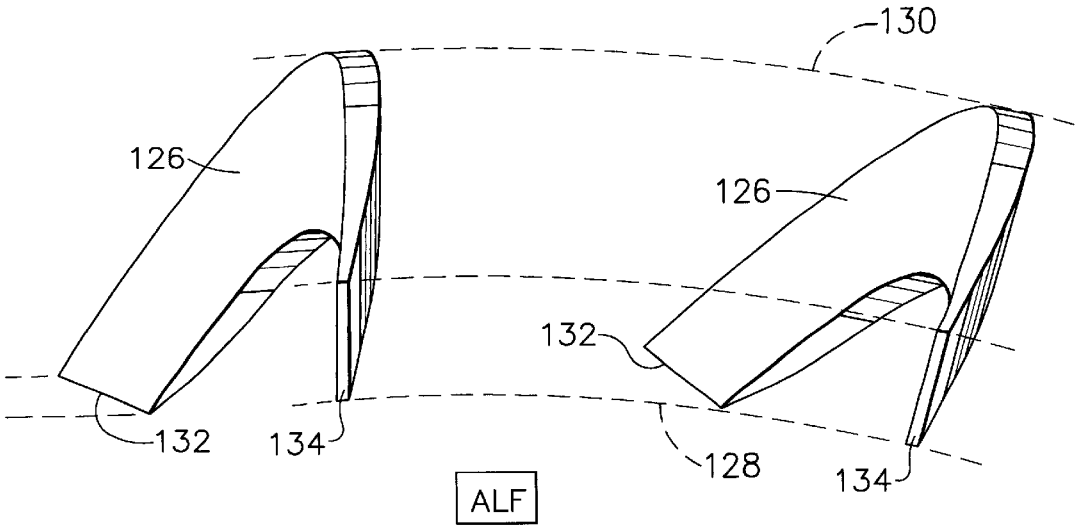
FIG. 4 represents an isolated perspective view of the deswirler vanes shown in FIGS. 2 and 3.

In a preferred embodiment, the deswirler vanes 126 are equally circumferentially spaced within the manifold 122. The radially inward and outward edges of each vane 126 are shown as being delimited by the two axi-symmetric curved surfaces 128 and 130 of the manifold 122. The shape of each vane 126 is determined aerodynamically so that the air or gas is simultaneously but gradually turned from the outward radial direction with substantial swirl angle (when it leaves the diffuser 116) to the meridional spouting direction with approximately zero swirl (as it enters the combustor inlet 112). For this purpose, and as best seen in FIG. 4, each vane 126 is also circumferentially-arcuate (i.e., arcuate relative to a longitudinal line parallel to the centerline of the engine), so as to provide arcuate gas flow path surfaces within the manifold 122 that promote the elimination of swirl. The radial height of each vane 126 will typically be dependent on the particular arcuate shape of the vane 126, as understood by those skilled in the art.

Figure 5:
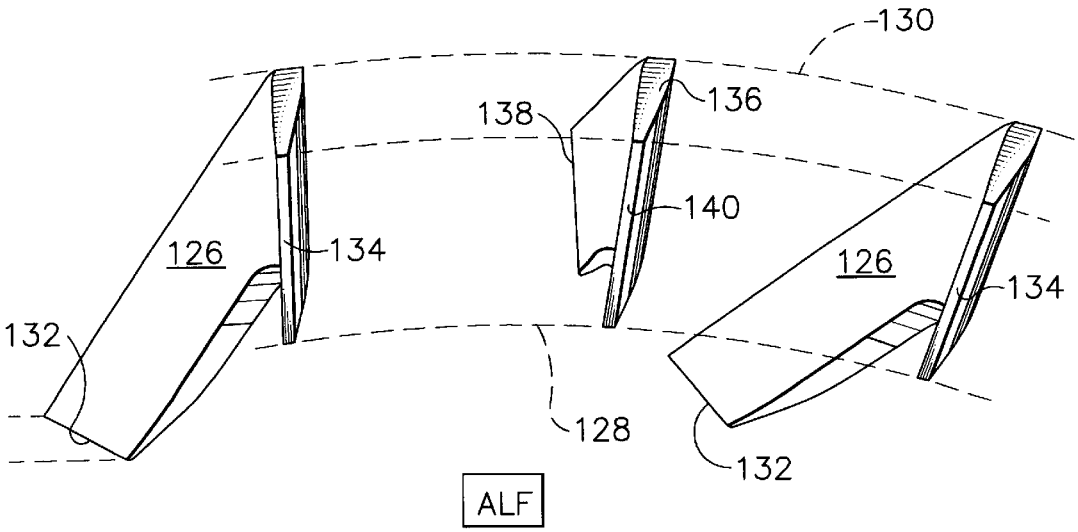

As shown in FIGS. 2 through 4, the leading edge 132 of each vane 126 is closely coupled to the diffuser 116, and the trailing edge 134 of each vane 126 is closely coupled to the combustor inlet 112. As such, each of the vanes 126 extends the entire length of the bend 124 between the inlet and outlet of the manifold 122. In FIG. 5, an alternative embodiment is shown in which alternate deswirler vanes 126 extend the entire length of the bend 124 between the inlet and outlet of the manifold 122, but those vanes 136 between the alternate vanes 126 do not. As shown in FIG. 5, the leading edge 138 of the shorter vane 136 is decoupled from the diffuser 116, while the trailing edge 140 remains closely coupled to the inlet 112 of the combustor. A benefit of this embodiment of the invention is a further reduction of engine axial length and reduced weight while maintaining performance improvements.

Shown in FIGS. 6 and 7 are two additional embodiments for deswirler vanes of this invention. In FIG. 6, deswirler vanes 142 are shown having a thicker trailing edge 146 as compared to their leading edges 144. In addition, a hole 148 is formed in one of the vanes 142 to accommodate the passage of a cooling or lubrication tube (not shown) through the vane 142, which may be necessary or advantageous in view of the compactness of the deswirl system of this invention. FIG. 7 also shows deswirler vanes 150 with thicker trailing edges 154 as compared to their leading edges 152. In contrast to the embodiment of FIG. 6, one of the vanes 150 is equipped with a slot 156 to accommodate a cooling or lubrication tube. By incorporating cooling and lubrication tubes within the vanes 142 and 150, a more uniform exit condition can be achieved, further reducing the risk of affecting the compressor stall margin.

An important aspect of the present invention is the potential for aerodynamic advantages realized through close coupling the deswirler vanes 126, 142 and 150 to the diffuser 116. At least one benefit arising from this feature of the invention is the determination that improved efficiencies can be achieved through appropriate relative circumferential positioning of the deswirler vanes 126, 142 and 150 relative to the passages between adjacent diffuser vanes 118. The benefits of this aspect of the invention are believed to be possible if the number of full-length deswirler vanes 126, 142 and/or 150 is an integer multiple of the number of diffuser passages, and more preferably equal to the number of diffuser passages. Testing has confirmed that enhanced engine performance occurs if each of the full-length deswirler vanes 126, 142 and/or 150 is circumferentially offset from one of the diffuser vanes.

In FIG. 8, this offset is schematically illustrated by an aft-looking-forward view of the diffuser vanes 118 and deswirler vanes 126, with the centerline of the engine indicated at "C." Tick marks are shown at intervals of one-quarter of the pitch "P" along the interface between the outer diameter of the diffuser vanes 118 and the inner diameter of the deswirler vanes 126. While offsets of between one-quarter and three-quarters have been evaluated, optimum results for the engine tested have been achieved where the offset between deswirler and diffuser vanes was between one-quarter and one-half pitch, approximately at about three-eighths pitch. The optimum offset for a given engine may vary for different compressor and combustor designs. However, the unconventional capability with this invention to optimize the diffuser-deswirler system match provides greater design flexibility in terms of minimizing losses attributable to the diffuser-deswirler interface.

While the invention has been described in terms of preferred and alternative embodiments, it is apparent that other forms could be adopted by one skilled in the art. For example, the deswirler system of this invention could be employed within a multistage centrifugal compressor and placed between each consecutive pair of stages. Therefore, the scope of the invention is to be limited only by the following claims.

What is claimed is:

1. A deswirler system of a centrifugal compressor for a gas turbine engine, the deswirler system being between a diffuser and a combustor of the gas turbine engine, the deswirler system comprising:

an annular-shaped manifold having an inlet configured to receive radially-outward flowing gas from the diffuser, an outlet configured to discharge the gas in an axial downstream direction into the combustor, and an arcuate passage therebetween; and a plurality of deswirler vanes within the arcuate passage, at least some of the deswirler vanes having a leading edge closely coupled to an outlet of the diffuser and a trailing edge closely coupled to an inlet to the combustor.

2. A deswirler system according to claim 1, wherein the deswirler vanes are equally circumferentially spaced within the arcuate passage.

3. A deswirler system according to claim 1, wherein the leading edge of each of the deswirler vanes is closely coupled to the outlet of the diffuser.

4. A deswirler system according to claim 1, wherein the trailing edge of each of the deswirler vanes is closely coupled to the inlet of the combustor.

5. A deswirler system according to claim 1, wherein each of the deswirler vanes extends the entire length of the arcuate passage between the inlet and outlet of the manifold.

6. A deswirler system according to claim 1, wherein at least some of the deswirler vanes do not extend the entire length of the arcuate passage between the inlet and outlet of the manifold.

7. A deswirler system according to claim 1, wherein at least one of the deswirler vanes has a portion at the trailing edge thereof that is thicker than the leading edge thereof.

8. A deswirler system according to claim 7, further comprising a conduit passing through the portion of the at least one deswirler vane.

9. A deswirler system according to claim 1, wherein the arcuate passage within the manifold is defined by two axi-symmetric curved surfaces, each of the deswirler vanes has radially inward and radially outward edges delimited by the curved surfaces of the manifold.

10. A deswirler system according to claim 1, wherein the diffuser comprises a plurality of diffuser passages defined by a plurality of diffuser vanes.

11. A deswirler system according to claim 10, wherein each of the deswirler vanes is circumferentially offset from one of the diffuser vanes.

12. A deswirler system according to claim 10, wherein the offset between each deswirler vane and a corresponding diffuser vane is between one-quarter and one-half pitch.

13. A deswirler system according to claim 10, wherein the deswirler vanes are present within the arcuate passage as an integer multiple of the number of diffuser passages.

14. A deswirler system according to claim 1, wherein each of the deswirler vanes defines a circumferentially-arcuate gas flow path surface within the arcuate passage.

15. A deswirler system of a centrifugal compressor for a gas turbine engine, the deswirler system being coupled to a diffuser system and an annular-shaped combustor of the gas turbine engine, the diffuser system comprising a plurality of radial diffuser passages defined by a plurality of diffuser vanes, the combustor having an annular-shaped inlet, the deswirler system comprising:

an annular-shaped manifold having an inlet that receives radially-outward flowing gas from the diffuser passages, an outlet that discharges the gas in an axial downstream direction into the inlet of the combustor, and an arcuate passage therebetween defined by two axi-symmetric curved surfaces, the arcuate passage turning the gas from the radially-outward flow of the diffuser passages to the axial downstream direction into the inlet of the combustor; and a plurality of deswirler vanes equally circumferentially spaced within the arcuate passage and equal in number to the diffuser passages, at least some of the deswirler vanes having a leading edge adjacent the diffuser system, a trailing edge adjacent the inlet to the combustor, and radially inward and radially outward edges delimited by the curved surfaces of the manifold, each of the deswirler vanes defining a circumferentially-arcuate gas flow path surface within the arcuate passage, each of the deswirler vanes being circumferentially offset from one of the diffuser vanes.

16. A deswirler system according to claim 15, wherein the leading edges of at least some of the deswirler vanes are closely coupled to the diffuser system, and wherein the trailing edge of each deswirler vane is closely coupled to the inlet of the combustor such that at least some of the deswirler vanes extend the entire length of the arcuate passage between the inlet and outlet of the manifold.

17. A deswirler system according to claim 15, wherein alternate deswirler vanes extend the entire length of the arcuate passage between the inlet and outlet of the manifold, and deswirler vanes between the alternate deswirler vanes do not extend the entire length of the arcuate passage.

18. A deswirler system according to claim 15, wherein at least one of the deswirler vanes has a portion at the trailing edge thereof that is thicker than the leading edge thereof, and a conduit passes through the portion of the at least one deswirler vane.

19. A deswirler system according to claim 15, wherein the offset between each deswirler vane and a corresponding diffuser vane is between one-quarter and one-half pitch.

20. A deswirler system according to claim 15, wherein the arcuate passage turns the flow from the diffuser system by at least 90 degrees up to about 180 degrees.

21. A deswirler system of a centrifugal compressor for a gas turbine engine, the deswirler system comprising:

an annular-shaped manifold having an inlet configured to receive radially-outward flowing gas from a diffuser, an outlet configured to discharge the gas in an axial downstream direction, and an arcuate passage therebetween; and a plurality of deswirler vanes within the arcuate passage, each of the deswirler vanes having a leading edge and a trailing edge, at least one of the deswirler vanes having a portion at the trailing edge thereof that is thicker than the leading edge thereof.

22. A deswirler system according to claim 21, further comprising a conduit passing through the portion of the at least one deswirler vane.

23. A deswirler system of a centrifugal compressor for a gas turbine engine, the deswirler system comprising:

an annular-shaped manifold having an inlet configured to receive radially-outward flowing gas from a diffuser that comprises a plurality of diffuser passages defined by a plurality of diffuser vanes, the manifold further having an outlet configured to discharge the gas in an axial downstream direction, and an arcuate passage therebetween; and a plurality of deswirler vanes within the arcuate passage, at least some of the deswirler vanes extending the entire length of the arcuate passage between the inlet and outlet of the manifold the at least some deswirler vanes being present within the arcuate passage as an integer multiple of the number of diffuser passages and being circumferentially offset from one of the diffuser vanes.

24. A deswirler system according to claim 23, wherein the offset between each of the at least some deswirler vanes and a corresponding diffuser vane is between one-quarter and one-half pitch.

25. A deswirler system according to claim 23, wherein the at least some deswirler vanes are present within the arcuate passage in a number equal to the number of diffuser passages.

* * * * *